US009040627B2

(12) United States Patent
Martin et al.

(10) Patent No.: US 9,040,627 B2
(45) Date of Patent: May 26, 2015

(54) ARTIFICIAL TURF YARN

(75) Inventors: Jill M. Martin, Pearland, TX (US); Peter Sandkuehler, Tarrangona (ES)

(73) Assignee: Dow Global Technologies LLC, Midland, MI (US)

( * ) Notice: Subject to any disclaimer, the term of this patent is extended or adjusted under 35 U.S.C. 154(b) by 183 days.

(21) Appl. No.: 13/639,757

(22) PCT Filed: Mar. 30, 2011

(86) PCT No.: PCT/US2011/030521

§ 371 (c)(1), (2), (4) Date: Oct. 5, 2012

(87) PCT Pub. No.: WO2011/126886

PCT Pub. Date: Oct. 13, 2011

(65) Prior Publication Data

US 2013/0030123 A1 Jan. 31, 2013

(30) Foreign Application Priority Data

Apr. 7, 2010 (EP) ..... 10382078

(51) Int. Cl.

| | |
|---|---|
| ***C08L 53/00*** | (2006.01) |
| ***C08L 23/04*** | (2006.01) |
| ***E01C 13/08*** | (2006.01) |
| ***D01F 6/46*** | (2006.01) |
| ***D06N 7/00*** | (2006.01) |

(52) U.S. Cl.

CPC . *E01C 13/08* (2013.01); *D01F 6/46* (2013.01); *D06N 7/0065* (2013.01); *D06N 2201/0254* (2013.01)

(58) Field of Classification Search

USPC ..... 525/88, 95; 428/17

See application file for complete search history.

(56) References Cited

U.S. PATENT DOCUMENTS

| | | | |
|---|---|---|---|
| 3,290,207 | A | 12/1966 | Magat et al. |
| 3,740,940 | A | 6/1973 | Berkowitch |
| 4,018,852 | A | 4/1977 | Schober |
| 4,179,875 | A | 12/1979 | Gibbon |
| 5,132,380 | A | 7/1992 | Stevens et al. |
| 5,346,961 | A | 9/1994 | Shaw et al. |
| 7,355,089 | B2 | 4/2008 | Chang et al. |
| 7,504,347 | B2 | 3/2009 | Poon et al. |
| 7,514,517 | B2 | 4/2009 | Hoenig et al. |
| 7,524,911 | B2 | 4/2009 | Karjala et al. |
| 7,579,408 | B2 | 8/2009 | Walton et al. |
| 7,582,716 | B2 | 9/2009 | Liang et al. |
| 7,608,668 | B2 | 10/2009 | Li Ri Shan et al. |
| 7,611,763 | B2 | 11/2009 | Atsma et al. |
| 2007/0116953 | A1 | 5/2007 | English et al. |
| 2007/0166507 | A1 | 7/2007 | Atsma et al. |
| 2009/0008824 | A1 | 1/2009 | Satori et al. |

FOREIGN PATENT DOCUMENTS

| | | | |
|---|---|---|---|
| EP | 00696300 | B1 | 12/1998 |
| EP | 1378592 | A1 | 1/2004 |
| EP | 1672020 | A1 | 6/2006 |
| EP | 1837423 | A1 | 9/2007 |
| JP | 4147122 | B2 | 9/2008 |
| WO | 99/04074 | A1 | 1/1999 |
| WO | 03/078705 | A1 | 9/2003 |
| WO | 2004/106601 | A1 | 12/2004 |
| WO | 2004/094129 | B1 | 2/2005 |
| WO | 2005/090427 | A2 | 9/2005 |
| WO | 2005/111281 | A1 | 11/2005 |
| WO | 2006/101930 | A2 | 9/2006 |
| WO | 2006/102149 | A2 | 9/2006 |
| WO | 2007/082817 | A1 | 7/2007 |
| WO | 2008/057886 | A2 | 5/2008 |
| WO | 2008/089031 | A2 | 7/2008 |
| WO | 2008/098905 | A2 | 8/2008 |
| WO | 2009/086091 | A1 | 7/2009 |

OTHER PUBLICATIONS

Potemkin et al., Physical Review E, vol. 57, No. 6, Jun. 1998, pp. 6902-6912.

Dobrynin, J. Chem Phys., 107(21), Dec. 1997, pp. 9234-9238.

Machine translation of JP 4147122B2.

*Primary Examiner* — Jeffrey Mullis

(74) *Attorney, Agent, or Firm* — Whyte Hirschboeck Dudek S.C.

(57) ABSTRACT

Provided is an artificial turf yarn having improved heat resistance, durability, softness and extensibility. The artificial turf yarn contains two components: an olefin block copolymer (OBC) and a linear low density polyethylene (LLDPE). The yarn includes from about 10 wt % to about 80 wt % of the OBC and from about 20 wt % to about 90 wt % of the LLDPE which produces an artificial turf yarn with improved softness and toughness while maintaining heat resistance.

18 Claims, No Drawings

ARTIFICIAL TURF YARN

CROSS REFERENCE TO RELATED APPLICATION

The present application is the national phase of PCT Patent Application No. PCT/US2011/030521 filed Mar. 30, 2011, which claims the benefit of European Application No. 10382078.3 filed Apr. 7, 2010.

BACKGROUND

Interest in artificial turf in recent years has been explosive. Artificial turf is increasingly used to replace natural grass on playing surfaces, in particular on sports fields and playgrounds. Artificial turf also finds application in landscaping and leisure settings. Conventional blends of metallocene catalyzed polyethylenes and/or Ziegler-Natta catalyzed polyethylenes for artificial turf yarn are soft, yet unfortunately lack heat resistance. Therefore, a need exists for an artificial turf yarn that is soft, strong, and also heat resistant.

SUMMARY

The present disclosure is directed to artificial turf yarn. The present artificial turf yarn has an unexpected combination of softness and heat resistance previously untenable in an artificial turf. The present yarn further exhibits requisite extensibility, resiliency, toughness, softness, and durability suitable for artificial turf.

The present disclosure provides an artificial turf yarn. In an embodiment, an artificial turf yarn is provided and comprises from about 10 wt % to about 80 wt % of an olefin block copolymer (OBC) having a density from about 0.866 g/cc to about 0.900 g/cc and from about 20 wt % to about 90 wt % of a linear low density polyethylene (LLDPE) having a density from about 0.910 g/cc to about 0.965 g/cc, and wherein the yarn has a shrinkage less than 8%.

The present disclosure provides an artificial turf yarn. In an embodiment, an artificial turf yarn is provided and comprises from about 10 wt % to about 80 wt % of an olefin block copolymer (OBC) and from about 20 wt % to about 90 wt % of a linear low density polyethylene (LLDPE). The yarn has a density less than 0.920 g/cc and a shrinkage less than 6%.

The present disclosure provides an artificial turf. In an embodiment, an artificial turf is provided and comprises a backing substrate, and a yarn coupled to the backing substrate. The yarn comprises from about 10 wt % to about 80 wt % of an olefin block copolymer (OBC) and from about 20 wt % to about 90 wt % of a linear low density polyethylene (LLDPE).

An advantage of the present disclosure is an improved artificial turf yarn.

An advantage of the present disclosure is an improved artificial turf.

An advantage of the present disclosure is the provision of an artificial turf yarn that combines the desired properties of heat resistance and softness.

An advantage of the present disclosure is the provision of an artificial turf yarn with thermal and UV stability.

An advantage of the present disclosure is the provision of an artificial turf yarn with exceptional extensibility.

An advantage of the present disclosure is the provision of an artificial turf yarn with abrasion resistance and improved durability.

DETAILED DESCRIPTION

The present disclosure provides a yarn for an artificial turf. The present artificial turf yarn provides an unexpected combination of softness and heat resistance. The present yarn also provides requisite extensibility, toughness, resilience and durability for artificial turf.

In an embodiment, an artificial turf yarn is provided. The artificial turf yarn includes from about 10 wt % to about 80 wt % of an olefin block copolymer (OBC) and from about 20 wt % to about 90 wt % of a linear low density polyethylene (LLDPE). The artificial turf yarn has a shrinkage less than 8%. The OBC and the LLDPE may or may not add up to 100 wt % of the artificial turf yarn. In a further embodiment, the yarn is composed of a blend of the OBC and the LLDPE.

The term "artificial turf," as used herein, is a carpet-like cover having substantially upright, or upright, polymer strands of artificial turf yarn projecting upwardly from a substrate. The term "artificial turf yarn" or hereafter "yarn" as used herein, includes fibrillated tape yarn, co-extruded tape yarns, monotape and monofilament yarn. A "fibrillated tape" or "fibrillated tape yarn," is a cast extruded film cut into tape (typically about 1 cm width), the film stretched and long slits cut (fibrillated) into the tape giving the tape the dimensions of grass blades. A "monofilament yarn" is extruded into individual yarn or strands with a desired cross-sectional shape and thickness followed by yarn orientation and relaxation in hot ovens. The artificial turf yarn forms the polymer strands for the artificial turf. Artificial turf requires resilience (spring-back), toughness, flexibility, extensibility and durability. Consequently, artificial turf yarn excludes yarn for fabrics (i.e., woven and/or knit fabrics).

The present artificial turf yarn includes an olefin block copolymer. An "olefin block copolymer," (or "OBC"), "olefin block interpolymer," "multi-block interpolymer," "segmented interpolymer" is a polymer comprising two or more chemically distinct regions or segments (referred to as "blocks") preferably joined in a linear manner, that is, a polymer comprising chemically differentiated units that are joined end-to-end with respect to polymerized olefinic, preferable ethylenic, functionality, rather than in pendent or grafted fashion. In an embodiment, the blocks differ in the amount or type of incorporated comonomer, density, amount of crystallinity, crystallite size attributable to a polymer of such composition, type or degree of tacticity (isotactic or syndiotactic), regio-regularity or regio-irregularity, amount of branching (including long chain branching or hyper-branching), homogeneity or any other chemical or physical property. Compared to block interpolymers of the prior art, including interpolymers produced by sequential monomer addition, fluxional catalysts, or anionic polymerization techniques, the multi-block interpolymers used in the practice of this disclosure are characterized by unique distributions of both polymer polydispersity (PDI or Mw/Mn or MWD), block length distribution, and/or block number distribution, due, in an embodiment, to the effect of the shuttling agent(s) in combination with multiple catalysts used in their preparation. More specifically, when produced in a continuous process, the polymers desirably possess PDI from about 1.7 to about 3.5, or from about 1.8 to about 3, or from about 1.8 to about 2.5, or from about 1.8 to about 2.2. When produced in a batch or semi-batch process, the polymers desirably possess PDI from about 1.0 to about 3.5, or from about 1.3 to about 3, or from about 1.4 to about 2.5, or from about 1.4 to about 2.

In an embodiment, the OBC has a hard segment content from about 10 wt % to about 30 wt %, or from about 20 wt % to about 25 wt %. The remaining portion (segment) content is soft segments (i.e., segments containing relatively higher amounts of comonomer content versus the hard segment content, which has little, if any, comonomer).

The term "ethylene multi-block interpolymer" is a multi-block interpolymer comprising ethylene and one or more interpolymerizable comonomers, in which ethylene comprises a plurality of the polymerized monomer units of at least one block or segment in the polymer, or at least 90, or at least 95, or at least 98, mole percent of the block. Based on total polymer weight, the ethylene multi-block interpolymers used in the practice of the present disclosure preferably have an ethylene content from 25 to 97, or from 40 to 96, or from 55 to 95, or from 65 to 85, percent.

Because the respective distinguishable segments or blocks formed from two or more monomers are joined into single polymer chains, the polymer cannot be completely fractionated using standard selective extraction techniques. For example, polymers containing regions that are relatively crystalline (high density segments) and regions that are relatively amorphous (lower density segments) cannot be selectively extracted or fractionated using differing solvents. In an embodiment, the quantity of extractable polymer using either a dialkyl ether or an alkane-solvent is less than 10, or less than 7, or less than 5, or less than 2, percent of the total polymer weight.

In addition, the multi-block interpolymers disclosed herein desirably possess a PDI fitting a Schultz-Flory distribution rather than a Poisson distribution. The use of the polymerization process described in WO 2005/090427 and U.S. Ser. No. 11/376,835 results in a product having both a polydisperse block distribution as well as a polydisperse distribution of block sizes. This results in the formation of polymer products having improved and distinguishable physical properties. The theoretical benefits of a polydisperse block distribution have been previously modeled and discussed in Potemkin, *Physical Review E* (1998) 57 (6), pp. 6902-6912, and Dobrynin, *J. Chem.Phys.* (1997) 107 (21), pp 9234-9238.

In a further embodiment, the multi-block interpolymers of the present disclosure, especially those made in a continuous, solution polymerization reactor, possess a most probable distribution of block lengths. In one embodiment of this disclosure, the ethylene multi-block interpolymers are defined as having:

(A) Mw/Mn from about 1.7 to about 3.5, at least one melting point, Tm, in degrees Celsius, and a density, d, in grams/cubic centimeter, where in the numerical values of Tm and d correspond to the relationship:

$$Tm>-2002.9+4538.5(d)-2422.2(d)^2, \text{ or}$$

(B) Mw/Mn from about 1.7 to about 3.5, and is characterized by a heat of fusion, ΔH in J/g, and a delta quantity, ΔT, in degrees Celsius defined as the temperature difference between the tallest DSC peak and the tallest Crystallization Analysis Fractionation ("CRYSTAF") peak, wherein the numerical values of ΔT and ΔH have the following relationships:

$\Delta T>-0.1299(\Delta H)+62.81$ for ΔH greater than zero and up to 130 J/g $\Delta T\geq 48°$ C. for ΔH greater than 130 J/g wherein the CRYSTAF peak is determined using at least 5 percent of the cumulative polymer, and if less than 5 percent of the polymer has an identifiable CRYSTAF peak, then the CRYSTAF temperature is 30° C.; or (C) elastic recovery, Re, in percent at 300 percent strain and 1 cycle measured with a compression-molded film of the ethylene/α-olefin interpolymer, and has a density, d, in grams/cubic centimeter, wherein the numerical values of Re and d satisfy the following relationship when ethylene/α-olefin interpolymer is substantially free of crosslinked phase:

$$Re>1481-1629(d); \text{ or}$$

(D) has a molecular weight fraction which elutes between 40° C. and 130° C. when fractionated using TREF, characterized in that the fraction has a molar comonomer content of at least 5 percent higher than that of a comparable random ethylene interpolymer fraction eluting between the same temperatures, wherein said comparable random ethylene interpolymer has the same comonomer(s) and has a melt index, density and molar comonomer content (based on the whole polymer) within 10 percent of that of the ethylene/α-olefin interpolymer; or (E) has a storage modulus at 25° C., G' (25° C.), and a storage modulus at 100° C., G' (100° C.), wherein the ratio of G' (25° C.) to G' (100° C.) is in the range of about 1:1 to about 9:1.

The ethylene/α-olefin interpolymer may also have:

(F) molecular fraction which elutes between 40° C. and 130° C. when fractionated using TREF, characterized in that the fraction has a block index of at least 0.5 and up to about 1 and a molecular weight distribution, Mw/Mn, greater than about 1.3; or (G) average block index greater than zero and up to about 1.0 and a molecular weight distribution, Mw/Mn greater than about 1.3.

Suitable monomers for use in preparing the ethylene multi-block interpolymers used in the practice of this present disclosure include ethylene and one or more addition polymerizable monomers other than ethylene. Examples of suitable comonomers include straight-chain or branched α-olefins of 3 to 30, preferably 3 to 20, carbon atoms, such as propylene, 1-butene, 1-pentene, 3-methyl-1-butene, 1-hexene, 4-methyl-1-pentene, 3-methyl-1-pentene, 1-octene, 1-decene, 1-dodecene, 1-tetradecene, 1-hexadecene, 1-octadecene and 1-eicosene; cyclo-olefins of 3 to 30, preferably 3 to 20, carbon atoms, such as cyclopentene, cycloheptene, norbornene, 5-methyl-2-norbornene, tetracyclododecene, and 2-methyl-1,4,5,8-dimethano-1,2,3,4,4a,5,8,8a-octahydronaphthalene; di- and polyolefins, such as butadiene, isoprene, 4-methyl-1,3-pentadiene, 1,3-pentadiene, 1,4-pentadiene, 1,5-hexadiene, 1,4-hexadiene, 1,3-hexadiene, 1,3-octadiene, 1,4-octadiene, 1,5-octadiene, 1,6-octadiene, 1,7-octadiene, ethylidenenorbornene, vinyl norbornene, dicyclopentadiene, 7-methyl-1,6-octadiene, 4-ethylidene-8-methyl-1,7-nonadiene, and 5,9-dimethyl-1,4,8-decatriene; and 3-phenylpropene, 4-phenylpropene, 1,2-difluoroethylene, tetrafluoroethylene, and 3,3,3-trifluoro-1-propene.

In an embodiment, the comonomer in the ethylene multi-block interpolymer is selected from octene, butene and hexene. In a further embodiment, the ethylene multi-block interpolymer is an ethylene/octene multi-block interpolymer.

Other ethylene multi-block interpolymers that can be used in the practice of this disclosure are elastomeric interpolymers of ethylene, a $C_{3-20}$ α-olefin, especially propylene, and, optionally, one or more diene monomers. The α-olefins for use in this embodiment of the present disclosure are designated by the formula $CH_2{=}CHR^*$, where R* is a linear or branched alkyl group of from 1 to 12 carbon atoms. Examples of suitable α-olefins include, but are not limited to, propylene, isobutylene, 1-butene, 1-pentene, 1-hexene, 4-methyl-1-pentene, and 1-octene. One particular α-olefin is propylene. The propylene based polymers are generally referred to in the art as EP or EPDM polymers. Suitable dienes for use in preparing such polymers, especially multi-block EPDM type-polymers include conjugated or non-conjugated, straight or branched chain-, cyclic- or polycyclic dienes containing from 4 to 20 carbon atoms. Dienes include 1,4-pentadiene, 1,4-hexadiene, 5-ethylidene-2-norbornene, dicyclopentadiene, cyclohexadiene, and 5-butylidene-2-norbornene. One particular diene is 5-ethylidene-2-norbornene.

Because the diene containing polymers contain alternating segments or blocks containing greater or lesser quantities of the diene (including none) and α-olefin (including none), the total quantity of diene and α-olefin may be reduced without loss of subsequent polymer properties. That is, because the diene and α-olefin monomers are preferentially incorporated into one type of block of the polymer rather than uniformly or randomly throughout the polymer, they are more efficiently utilized and subsequently the crosslink density of the polymer can be better controlled. Such crosslinkable elastomers and the cured products have advantaged properties, including higher tensile strength and better elastic recovery.

The ethylene multi-block interpolymers useful in the practice of this disclosure have a density of less than or equal to about 0.90, or less than about 0.89. In an embodiment, the ethylene multi-block interpolymer (the OBC) has a density from about 0.866 g/cc to less than or equal to about 0.900 g/cc, or from about 0.866 g/cc to about 0.887 g/cc. Such low density ethylene multi-block interpolymers are generally characterized as amorphous, flexible and having good optical properties, e.g., high transmission of visible and UV-light and low haze.

The ethylene multi-block interpolymers useful in the practice of this disclosure typically have a melt index (MI) from about 1 g/10 min to about 10 g/10 min as measured by ASTM D 1238 (190° C./2.16 kg).

The ethylene multi-block interpolymers useful in the practice of this disclosure have a 2% secant modulus of less than about 150, or less than about 140, or less than about 120, or less than about 100, MPa as measured by the procedure of ASTM D 882-02. The ethylene multi-block interpolymers typically have a 2% secant modulus of greater than zero, but the lower the modulus, the better the interpolymer is adapted for use in this disclosure. The secant modulus is the slope of a line from the origin of a stress-strain diagram and intersecting the curve at a point of interest, and it is used to describe the stiffness of a material in the inelastic region of the diagram. Low modulus ethylene multi-block interpolymers are particularly well adapted for use in this disclosure because they provide stability under stress, e.g., less prone to crack upon stress.

The ethylene multi-block interpolymers useful in the practice of this disclosure typically have a melting point of less than about 125° C. The melting point is measured by the differential scanning calorimetry (DSC) method described in WO 2005/090427 (US2006/0199930).

The ethylene multi-block interpolymers used in the practice of this disclosure, and their preparation and use, are more fully described in U.S. Pat. Nos. 7,579,408, 7,355,089, 7,524,911, 7,514,517, 7,582,716 and 7,504,347.

The artificial turf yarn also includes LLDPE. The LLDPE comprises, in polymerized form, a majority weight percent of ethylene based on the total weight of the LLDPE. In an embodiment, the LLDPE is an interpolymer of ethylene and at least one ethylenically unsaturated comonomer. In one embodiment, the comonomer is a $C_3$-$C_{20}$ α-olefin. In another embodiment, the comonomer is a $C_3$-$C_8$ α-olefin. In another embodiment, the $C_3$-$C_8$ α-olefin is selected from propylene, 1-butene, 1-hexene, or 1-octene. In an embodiment, the LLDPE is selected from the following copolymers: ethylene/propylene copolymer, ethylene/butene copolymer, ethylene/hexene copolymer, and ethylene/octene copolymer. In a further embodiment, the LLDPE is an ethylene/octene copolymer.

The LLDPE has a density from about 0.910 g/cc to about 0.965 g/cc, or from about 0.920 g/cc to about 0.95 g/cc. The LLDPE has a melt index from about 0.5 g/10 min to about 10 g/10 min, or about 1 g/10 min to about 5 g/10 min as measured in accordance with ASTM D 1238 (190° C. and 2.16 kg).

The LLDPE can be produced with Ziegler-Natta catalysts, or single-site catalysts, such as vanadium catalysts and metallocene catalysts. In an embodiment, the LLDPE is produced with a Ziegler-Natta type catalyst. LLDPE is linear and does not contain long chain branching and is different than low density polyethylene ("LDPE") which is branched or heterogeneously branched polyethylene.

In an embodiment, the LLDPE is a Ziegler-Natta catalyzed ethylene and octene copolymer and has a density of 0.935 g/cc and a melt index of about 2.5 g/10 min as measured in accordance with ASTM D 1238 (190° C. and 2.16 kg).

Nonlimiting examples of suitable Ziegler-Natta catalyzed LLDPE are polymers sold under the tradename DOWLEX, available from The Dow Chemical Company, Midland, Mich. and include but are not limited to DOWLEX 2025G, DOWLEX SC 2108G, DOWLEX 2036G, DOWLEX 2045, 11G, DOWLEX 2045G, DOWLEX 2107G, and DOWLEX 2045 S, DOWLEX 2055G, DOWLEX 2247G, and DOWLEX 2047G. In an embodiment, the LLDPE is DOWLEX 2036G.

In an embodiment, the LLDPE is a single-site catalyzed LLDPE ("sLLDPE"). As used herein, "sLLDPE" is a LLDPE polymerized using a single site catalyst such as a metallocene catalyst or a constrained geometry catalyst. A "metallocene catalyst" is a catalyst composition containing one or more substituted or unsubstituted cyclopentadienyl moiety in combination with a Group 4, 5, or 6 transition metal. Nonlimiting examples of suitable metallocene catalysts are disclosed in U.S. Pat. No. 5,324,800, the entire content of which is incorporated herein by reference. A "constrained geometry catalyst" comprises a metal coordination complex comprising a metal of groups 3-10 or the Lanthanide series of the Periodic Table and a delocalized pi-bonded moiety substituted with a constrain-inducing moiety, said complex having a constrained geometry about the metal atom such that the angle at the metal between the centroid of the delocalized, substituted pi-bonded moiety and the center of at least one remaining substituent is less than such angle in a similar complex containing a similar pi-bonded moiety lacking in such constrain-inducing substituent, and provided further that for such complexes comprising more than one delocalized, substituted pi-bonded moiety, only one thereof for each metal atom of the complex is a cyclic, delocalized, substituted pi-bonded moiety. The constrained geometry catalyst further comprises an activating cocatalyst. Nonlimiting examples of suitable constrained geometry catalysts are disclosed U.S. Pat. No. 5,132,380, the entire content of which is incorporated by reference herein.

The sLLDPE, may be unimodal or multimodal (i.e., bimodal). A "unimodal sLLDPE" is a LLDPE polymer prepared from one single-site catalyst under one set of polymerization conditions. Nonlimiting examples of suitable unimodal sLLDPE include those sold under the trade names EXACT and EXCEED, available from the ExxonMobil Chemical Company, Houston, Tex.; and ENGAGE and AFFINITY available from The Dow Chemical Company, Midland, Mich.

In an embodiment, the sLLDPE is multimodal. A "multimodal sLLDPE" is a LLDPE polymer prepared from one, two, or more different catalysts and/or under two or more different polymerization conditions. A "multimodal sLLDPE" comprises at least a lower molecular weight component (LMW) and a higher molecular weight (HMW) component.

Each component is prepared with a different catalyst and/or under different polymerization conditions. The prefix "multi" relates to the number of different polymer components present in the polymer. A nonlimiting example of multimodal sLLDPE is set forth in U.S. Pat. No. 5,047,468, the entire content of which is incorporated by reference herein. Further nonlimiting examples of suitable multimodal sLLDPE include those sold under the tradename and ELITE available from The Dow Chemical Company, Midland, Mich.

The comonomer of the OBC and the LLDPE may be the same or different. In an embodiment, the comonomer of the OBC and the comonomer of the LLDPE are the same and may be butene, hexene, or octene. In a further embodiment, the OBC is an ethylene/octene multi-block interpolymer and the LLDPE is an ethylene/octene copolymer.

The present artificial turf yarn has a shrinkage of less than 8%. The term "shrinkage," as used herein, is the percentage length reduction of 1 meter of yarn after inserting the yarn in 90° C. hot silicone oil for 20 seconds. The yarn is measured immediately after removal from the bath using an appropriate length measuring device. The surface on which the yarn is placed should be free from defects so that the yarn may retract or shrink freely. Shrinkage is calculated by subtracting the reduced yarn length from the original yarn length and dividing the result by the original yarn length and multiplying by 100. Shrinkage is an indirect measure of heat resistance. The lower the shrinkage value, the greater the heat resistance of the material.

In an embodiment, the present artificial turf yarn has a lower limit for shrinkage of 0%, or 0.1%, or 0.2%, or 0.3%, or 0.4%, or 0.5%, and an upper limit for shrinkage of less than 8%, or less than 7%, or less than 6%, or less than 5%, or less than 4%, or less than 3%.

In an embodiment, the blend of the artificial turf yarn has a density from about 0.905 g/cc to about 0.940 g/cc, or from about 0.905 g/cc to about 0.930 g/cc and a shrinkage of less than 8%, or from 0% to less than 8%, or from about 0.1% to less than 6%, or from about 0.1% to less than 5.0%. In another embodiment, the blend has a melt index from about 1 g/10 min to about 8 g/10 min as measured in accordance with ASTM D 1238 (190° C. and 2.16 kg).

In an embodiment, the present artificial turf yarn has a density less than 0.920 g/cc or less than or equal to 0.918 g/cc, and a shrinkage less than 6%, or 0% to less than 6%, or 0.1% to less than 5%.

Applicants have surprisingly discovered that an OBC with a density from about 0.866 g/cc to about 0.900 g/cc (or from about 0.866 g/cc to about 0.887 g/cc) blended with an LLDPE with a density from about 0.910 g/cc to about 0.965 g/cc (or from about 0.910 g/cc to about 0.950 g/cc) unexpectedly produces an artificial turf yarn with a previously unobtainable combination of desired properties, namely high softness, high toughness, high flexibility, and high resiliency while simultaneously maintaining high heat resistance (i.e., low shrinkage). In particular, the present blend of OBC and LLDPE unexpectedly yields artificial turf yarn with lower shrinkage compared to conventional artificial turf yarns at the same density. Bounded by no particular theory, it is believed that the alternating hard segment and soft segment multi-block structure of the OBC provides resistance at the yarn surface preventing yarn shrinkage and/or yarn curling. The OBC further exhibits compatibility with the LLDPE, the LLDPE providing the requisite tensile properties for the artificial turf. Thus, a tough, durable, flexible, extensible, resilient artificial turf yarn composed of the OBC/LLDPE blend in the softness range (i.e., density range) from about 0.905 g/cc to about 0.940 g/cc, or from about 0.905 g/cc to about 0.930 g/cc, in combination with high heat resistance (shrinkage less than 8%) is unprecedented, unexpected, and unpredictable.

In another embodiment, the artificial turf yarn is composed of a blend of from about 20 wt % to about 50 wt % OBC and from about 50 wt % to about 80 wt % of LLDPE.

In an embodiment, the OBC has a density from about 0.866 g/cc to about 0.887 g/cc or from about 0.877 g/cc to about 0.887 g/cc, as measured in accordance with ASTM D 792.

In an embodiment, the OBC has a melt index from about 0.5 g/10 min to about 5 g/10 min or from about 1 g/10 min to about 5 g/10 min as measured in accordance with ASTM D 1238 (190° C. and 2.16 kg).

In an embodiment, the yarn is produced by spinneret extrusion to form continuous filaments of semi-solid polymer. In the initial state, the fiber-forming polymers are solids, and therefore, must be first converted into a melt state for extrusion. This is usually achieved by melt blending, but can also be achieved through the use of solvents or through chemical treatments. The extruded blend is then stretched and/or relaxed and/or annealed in one or more ovens. Oven relaxation may reduce yarn shrinkage.

In an embodiment, a film, a tape or a filament composed of the blend is heated in a hot air oven (from about 90° C. to about 105° C.), stretched at a draw ratio from about 4.0 to about 10.0, or from about 4.5 to about 5.5, and subsequently annealed (from about 90° C. to about 120° C.). The term "draw ratio," as used herein, is the ratio of the speeds of the first and second pull-roll stands, used to orient the yarn during manufacture. The draw ratio exceeds the natural draw ratio. This process yields a yarn with high tensile strength, an appropriate linear weight (dtex), residual elongation from about 30% to about 150% and shrinkage from about 0% to less than about 8%. Bounded by no particular theory, it is believed that tenacity increases with the draw ratio and is related to the molecular chain orientation. The draw ratio is selected to provide the yarn with sufficient tensile strength to withstand artificial turf construction and stresses during play but limit the level of orientation to avoid premature fibrillation after installation.

In an embodiment, the OBC/LLDPE blend is formed into a monofilament yarn with a tenacity greater than about 0.7 cN/dtex, or greater than about 0.7 cN/dtex to about 5.0 cN/dtex, or greater than about 0.7 cN/dtex to about 2.0 cN/dtex, or about 1.3 cN/dtex. Tenacity is a measure of yarn and/or turf toughness. The monofilament yarn may also have an elongation at failure of at least 50%, or at least 90%, or at least 95%, or at least 110%, or at least 140%.

In another embodiment, the present OBC/LLDPE blend is formed into a multi-strand fibrillated tape with a tenacity from about 5000 dtex to about 20,000 dtex.

The present disclosure provides another artificial turf yarn. In an embodiment, an artificial turf yarn is provided and includes from about 10 wt % to about 80 wt % of an OBC and from about 20 wt % to about 90 wt % of an LLDPE. The yarn has a density less than 0.920 g/cc, or less than or equal to 0.918 g/cc as measured in accordance with ASTM D 792. The yarn also has a shrinkage less than 6.0%, or from 0% to less than 6.0%, or from 0.1% to less than 5.0%. The OBC and the LLDPE may be any respective OBC and LLDPE with any respective property (or properties) as previously disclosed herein. In a further embodiment, the OBC and the LLDPE are a blend. The blend may have any property (or properties) as previously disclosed herein.

In an embodiment, the artificial turf yarn is oriented by a draw ratio of 5.3 in a hot air oven at 96° C., and relaxed in an relaxation oven at a ratio of 0.757 at 103° C. providing the yarn with a tenacity from about from about 0.7 cN/dtex to about 5.0 cN/dtex, or from about 0.7 cN/dtex to about 2.0 cN/dtex, or about 1.3 cN/dtex.

In an embodiment, the yarn is oriented. The artificial turf yarn has a density from about 0.905 g/cc to about 0.940 g/cc and a crystallinity from about 20 wt % to about 65 wt %, or from about 38 wt % to about 62 wt %.

Any of the foregoing artificial turf yarns may comprise two or more embodiments disclosed herein.

Any of the foregoing artificial turf yarns may include one or more additives. Nonlimiting examples of suitable additives include antioxidants, pigments, colorants, UV stabilizers, UV absorbers, curing agents, cross linking co-agents, boosters and retardants, processing aids, fillers, coupling agents, ultraviolet absorbers or stabilizers, antistatic agents, nucleating agents, slip agents, plasticizers, lubricants, viscosity control agents, tackifiers, anti-blocking agents, surfactants, extender oils, acid scavengers, and metal deactivators. Additives can be used in amounts ranging from less than about 0.01 wt % to more than about 10 wt % based on the weight of the composition.

Nonlimiting examples of pigments include inorganic pigments that are suitably colored to provide an aesthetic appeal including various shades of green, white ($TiO_2$, rutile), iron oxide pigments, and any other color.

Examples of antioxidants are as follows, but are not limited to: hindered phenols such as tetrakis[methylene(3,5-di-tert-butyl-4-hydroxyhydro-cinnamate)]methane; bis[(beta-(3,5-ditert-butyl-4-hydroxybenzyl)-methylcarboxyethyl)]sulphide, 4,4'-thiobis(2-methyl-6-tert-butylphenol), 4,4'-thiobis(2-tert-butyl-5-methylphenol), 2,2'-thiobis(4-methyl-6-tert-butylphenol), and thiodiethylene bis(3,5-di-tert-butyl-4-hydroxy)hydrocinnamate; phosphites and phosphonites such as tris(2,4-di-tert-butylphenyl)phosphite and di-tert-butylphenyl-phosphonite; thio compounds such as dilaurylthiodipropionate, dimyristylthiodipropionate, and distearylthiodipropionate; various siloxanes; polymerized 2,2,4-trimethyl-1,2-dihydroquinoline, n,n'-bis(1,4-dimethylpentyl-p-phenylenediamine), alkylated diphenylamines, 4,4'-bis(alpha, alpha-demthylbenzyl)diphenylamine, diphenyl-p-phenylenediamine, mixed di-aryl-p-phenylenediamines, and other hindered amine antidegradants or stabilizers. Antioxidants can be used in amounts of about 0.1 to about 5 wt % based on the weight of the composition.

Examples of curing agents are as follows: dicumyl peroxide; bis(alpha-t-butyl peroxyisopropyl)benzene; isopropylcumyl t-butyl peroxide; t-butylcumylperoxide; di-t-butyl peroxide; 2,5-bis(t-butylperoxy)2,5-dimethylhexane; 2,5-bis(t-butylperoxy)2,5-dimethylhexyne-3; 1,1-bis(t-butylperoxy)3,3,5-trimethylcyclohexane; isopropylcumyl cumylperoxide; di(isopropylcumyl) peroxide; or mixtures thereof. Peroxide curing agents can be used in amounts of about 0.1 to 5 wt % based on the weight of the composition. Various other known curing co-agents, boosters, and retarders, can be used, such as triallyl isocyanurate; ethyoxylated bisphenol A dimethacrylate; α-methyl styrene dimer; and other co-agents described in U.S. Pat. Nos. 5,346,961 and 4,018,852.

Examples of processing aids include but are not limited to metal salts of carboxylic acids such as zinc stearate or calcium stearate; fatty acids such as stearic acid, oleic acid, or erucic acid; fatty amides such as stearamide, oleamide, erucamide, or n,n'-ethylenebisstearamide; polyethylene wax; oxidized polyethylene wax; polymers of ethylene oxide; copolymers of ethylene oxide and propylene oxide; vegetable waxes; petroleum waxes; non ionic surfactants; and polysiloxanes. Processing aids can be used in amounts of about 0.05 to about 5 wt % based on the weight of the composition.

Examples of UV stabilizers and UV absorbers include but are not limited to hindered amine light stabilizers, benzophenone, benzotriazoie, hydroxyphenyl triazine, 2-(2'-hydroxyphenyl)benzotriazoles, Uvinol 3000, Tinuvin P, Irganox 1098, Uvinol 3008, Lavinix, BHT, Tinuvin 320, Irganox 1010, rganox 1076, and Irgafos 168.

The present disclosure provides an artificial turf. In an embodiment, an artificial turf is provided and includes a backing substrate and a yarn. The yarn is coupled to the backing substrate. The yarn may be any artificial turf yarn as previously disclosed herein. The yarn is any yarn as previously disclosed herein. The yarn is composed of from about 10 wt % to about 80 wt % of an OBC and from about 20 wt % to about 90 wt % of a LLDPE. The yarn has a density from 0.905 g/cc to 0.940 g/cc and a shrinkage of 0% to less than about 8%, or from 0.1% to less than about 6%, or from 0.1% to less than about 5%.

The term "coupled," or "coupling," as used herein, includes but is not limited to affixing, attaching, connecting, fastening, joining, linking or securing one object to another object through a direct or indirect relationship. In an embodiment, the yarn is coupled to the backing substrate using a tufting machine. A tufting machine resembles a sewing machine except that it has instead of a single needle, a whole row of needles or a couple of adjacent rows of staggered needles. The needles are used to stitch face loops into a pre-formed layer of backing. Loopers are used in conjunction with the needles to maintain the yarn loops that are being inserted at a desired pile height.

In an embodiment, the yarn of the artificial turf includes LLDPE with a density from about 0.910 g/cc to about 0.965 g/cc or from about 0.910 g/cc to about 0.950 g/cc, as measured in accordance with ASTM D 792.

In an embodiment, the yarn of the artificial turf includes OBC with a melt index from about 0.5 g/10 min to about 5 g/10 min as measured in accordance with ASTM D 1238 (190° C. and 2.16 kg).

In an embodiment, the yarn of the artificial turf includes LLDPE with a melt index from about 0.5 g/10 min to about 10 g/10 min, as measured in accordance with ASTM D 1238 (190° C., 2.16 kg).

In an embodiment, the yarn of the artificial turf includes a blend containing from about 20 wt % to about 50 wt % of the OBC and from about 50 wt % to about 80 wt % of the LLDPE.

In an embodiment, the yarn of the artificial turf includes yarn with a density less than 0.940 g/cc and a shrinkage less than 8%.

In another embodiment, an artificial turf is provided and includes a backing substrate having a face surface and a back surface, an adhesive backing material and, optionally, a secondary backing material. To form the face surface, yarn is tufted through the backing substrate such that the longer length of each stitch extends through the face surface of the primary backing material.

A nonlimiting way to make the face of the backing substrate includes a cut pile design. The yarn loops are cut, either during tufting or after, to produce a pile of single yarn ends instead of loops.

Backing substrate includes but is not limited to woven, knitted, or non-woven fibrous webs or fabrics made of one or more natural or synthetic fibers or yarns, such as jute, wool, polypropylene, polyethylene, polyamides, polyesters, and rayon. Nonlimiting examples of suitable materials for the backing substrate include polyurethane or latex-based materials such as styrene-butadiene or acrylates supplied under the tradenames DL552 from The Dow Chemical Company or in the case of a polyurethane backing, ENFORCER™ or ENHANCER™ also available from The Dow Chemical Company.

In some embodiments, the backing substrate may be formed from fibers such as synthetic fibers, natural fibers, or combinations thereof. Synthetic fibers include, for example, polyester, acrylic, polyamide, polyolefin, polyaramid, polyurethane, regenerated cellulose, and blends thereof. Polyesters may include, for example, polyethylene terephthalate, polytriphenylene terephthalate, polybutylene terephthalate, polylatic acid, and combinations thereof. Polyamides may include, for example, nylon 6, nylon 6,6, and combinations thereof. Polyolefins may include, for example, propylene based homopolymers, copolymers, and multi-block interpolymers, and ethylene based homopolymers, copolymers, and multi-block interpolymers, and combinations thereof. Polyaramids may include, for example, poly-p-phenyleneteraphthalamid (KEVLAR™), poly-m-phenyleneteraphthalamid (NOMEX™), and combinations thereof. Natural fibers may include, for example, wool, cotton, flax, and blends thereof. Other suitable materials include the thermoplastic resins as disclosed above.

The backing substrate may be formed from fibers or yarns of any size, including microdenier fibers and yarns (fibers or yarns having less than one denier per filament). The backing substrate may be comprised of fibers such as staple fiber, filament fiber, spun fiber, or combinations thereof. The backing may be of any variety, including but not limited to, woven fabric, knitted fabric, non-woven fabric, or combinations thereof.

In an embodiment, the backing substrate may include bicomponent fibers, multi-layer films, metals, textiles, and ceramics. Non-woven fabric may include elastic non-wovens and soft non-woven fabric. In another embodiment, the backing substrate may include fabrics or other textiles, porous films, and other non-wovens, including coated substrates. In another embodiment, the backing substrate may be a soft textile, such as a soft or elastic non-woven, such as an elastomeric polyolefin or a polyurethane, for example. Wovens and/or knits made from microdenier fibers may also provide the desired substrate performance.

In another embodiment, the non-woven fabric may be based on polyolefin mono-component fibers, such as ethylene-based or propylene-based polymers. In other embodiments, bicomponent fibers may be used, for example where the core is based on a polypropylene and the sheath may be based on polyethylene. It should be understood that the fibers used in embodiments of the backing substrate may be continuous or non-continuous, such as staple fibers.

In an embodiment, a web having similar physical properties to those described above may also be utilized. The web structure may be formed from individual fibers, filaments, or threads which are interlaid, but not in an identifiable manner, Non-woven fabrics or webs can be formed from several processes such as melt blowing, spun-bonding, electrospun, and bonded carded web processes. The basis weight of the non-wovens may range from about 25 $g/m^2$ to greater then 150 $g/m^2$.

In an embodiment, the yarn also comprises a secondary backing. A secondary backing may be coupled to the undersurface of the primary backing. To produce yarns with a secondary backing, the bottom surface of the backing is coated with an adhesive backing material. Then, the secondary backing is coupled to the coated bottom surface and the resulting structure is passed through an oven to bind the secondary backing to the backing substrate.

Adhesive backing materials include curable latex, urethane or vinyl systems, with latex systems being most common. Conventional latex systems are low viscosity, aqueous compositions that are applied at high production rates and offer good fiber-to-backing adhesion, tuft bind strength and adequate flexibility. Generally, excess water is driven off and the latex is cured by passing through a drying oven. Styrene butadiene rubbers (SBR) are the most common polymers used for latex adhesive backing materials. Typically, the latex backing system is heavily filled with an inorganic filler such as calcium carbonate or aluminum trihydrate and includes other ingredients such as antioxidants, antimicrobials, flame retardants, smoke suppressants, wetting agents, and froth aids.

The secondary backings are typically woven or non-woven fabrics made of one or more natural or synthetic fibers or yarns. Secondary backings may include open weave or Jeno weave, i.e., tape yarn in the warp direction and spun staple fiber in the fill direction.

Artificial turf generally is made "upside down" in the sense that as the primary backing is pulled from a feed roll and across the horizontal bedplate of the tufting machine. The loops are then stitched downwards through the backing so that the pile is formed below the plane of the primary backing. Then, some type of adhesive and/or a secondary backing, either of which may include a layer of foamed rubber or plastic padding or self-underlayment are coupled, usually in a downward direction or a sideways direction, to the exposed surface that is to become the underside of the turf. The secondary backing can be coupled directly or indirectly to the primary backing.

In an embodiment, the artificial turf further comprises a shock absorption layer coupled to the backing substrate of the artificial turf. The shock absorption layer can be made from polyurethane, PVC foam plastic or polyurethane foam plastic, a rubber, a closed-cell crosslinked polyethylene foam, a polyurethane underpad having voids, elastomer foams of polyvinyl chloride, polyethylene, polyurethane, and polypropylene. Non-limiting examples of a shock absorption layer are DOW™ ENFORCER™ Sport Polyurethane Systems, and DOW™ ENHANCER™ Sport Polyurethane Systems. In an embodiment, coating and foams can be used.

In another embodiment, the artificial turf includes an infill material. Materials that may be used as infill materials include but are not limited to mixtures of granulated rubber particles like SBR (styrene butadiene rubber) recycled from car tires, EPDM (ethylene-propylene-diene monomer), other vulcanised rubbers or rubber recycled from belts, thermoplastic elastomers (TPEs) and thermoplastic vulcanizates (TPVs).

In another embodiment, the artificial turf further includes a drainage system. The drainage system allows water to be removed from the artificial turf and prevents the turf from becoming saturated with water. Nonlimiting examples of drainage systems include stone-based drainage systems, EXCELDRAIN Sheet 100, EXCELDRAIN Sheet 200, AND EXCELDRAIN EX-T STRIP (available from American Wick Drain, Monroe, N.C.).

DEFINITIONS

All references to the Periodic Table of the Elements herein shall refer to the Periodic Table of the Elements, published and copyrighted by CRC Press, Inc., 2003. Also, any references to a Group or Groups shall be to the Groups or Groups reflected in this Periodic Table of the Elements using the IUPAC system for numbering groups. Unless stated to the contrary, implicit from the context, or customary in the art, all parts and percents are based on weight. For purposes of United States patent practice, the contents of any patent, patent application, or publication referenced herein are hereby incorporated by reference in their entirety (or the equivalent US version thereof is so incorporated by reference), especially with respect to the disclosure of synthetic techniques, definitions (to the extent not inconsistent with any definitions provided herein) and general knowledge in the art.

Any numerical range recited herein, includes all values from the lower value to the upper value, in increments of one unit, provided that there is a separation of at least 2 units between any lower value and any higher value. As an example, if it is stated that the amount of a component, or a value of a compositional or a physical property, such as, for example, amount of a blend component, softening temperature, melt index, etc., is between 1 and 100, it is intended that all individual values, such as, 1, 2, 3, etc., and all subranges, such as, 1 to 20, 55 to 70, 197 to 100, etc., are expressly enumerated in this specification. For values which are less than one, one unit is considered to be 0.0001, 0.001, 0.01 or 0.1, as appropriate. These are only examples of what is specifically intended, and all possible combinations of numerical values between the lowest value and the highest value enumerated, are to be considered to be expressly stated in this application. In other words, any numerical range recited herein includes any value or subrange within the stated range. Numerical ranges have been recited, as discussed herein, reference melt index, melt flow rate, and other properties.

The term "additive," as used herein, includes but is not limited to antioxidants, curing agents, cross-linking co-agents, boosters and retardants, processing aids, fillers, coupling agents, ultraviolet absorbers or stabilizers, antistatic agents, nucleating agents, slip agents, plasticizers, lubricants, viscosity control agents, tackifiers, anti-blocking agents, surfactants, extender oils, acid scavengers, and metal deactivators.

The terms "blend" or "polymer blend," as used herein, is a blend of two or more polymers. Such a blend may or may not be miscible (not phase separated at molecular level). Such a blend may or may not be phase separated. Such a blend may or may not contain one or more domain configurations, as determined from transmission electron spectroscopy, light scattering, x-ray scattering, and other methods known in the art.

The term "composition," as used herein, includes a mixture of materials which comprise the composition, as well as reaction products and decomposition products formed from the materials of the composition.

The term "comprising," and derivatives thereof, is not intended to exclude the presence of any additional component, step or procedure, whether or not the same is disclosed herein. In order to avoid any doubt, all compositions claimed herein through use of the term "comprising" may include any additional additive, adjuvant, or compound whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed. The term "or", unless stated otherwise, refers to the listed members individually as well as in any combination.

The term "crystallization analysis fractionation," as used herein, is an analytical process used to monitor the solution crystallization of polyolefins that will allow the calculation of the overall short chain branching distribution (SCBD). The analysis is carried out by monitoring the polymer solution concentration during crystallisation by temperature reduction.

The term "elongation at failure," as used herein, is the percentage a yarn has increased in length when stretched until breaking. Elongation is calculated by subtracting the original length of the yarn as measured between grips on a testing apparatus from the stretched yarn length at breaking and dividing the result by the original yarn length and multiplying by 100.

The term "ethylene-based polymer," as used herein, is a polymer that comprises a majority weight percent polymerized ethylene monomer (based on the total weight of polymerizable monomers), and optionally may comprise at least one polymerized comonomer.

The term "ethylene/α-olefin interpolymer," as used herein, is an interpolymer that comprises a majority weight percent polymerized ethylene monomer (based on the total amount of polymerizable monomers), and at least one polymerized α-olefin.

The term "fibrillated tape yarn," as used herein, is polymer strands that are produced from an extruded film, which is first cut into bands. In these bands, longitudinal slits are made so that laterally interconnected filaments are formed. These slits can be made for example by use of a drum provided with needles (and rotated at a speed different from the speed of the film led over this drum) or teeth.

The term "infill," as used herein, is a granular material that is dispersed between yarns of an artificial turf.

The term "interpolymer," as used herein, is a polymer prepared by the polymerization of at least two different types of monomers. The generic term interpolymer thus includes copolymers, usually employed to refer to polymers prepared from two different monomers, and polymers prepared from more than two different types of monomers.

The term "monofilament yarn," as used herein, is an oriented strand/fiber/filament tape of polymer that is extruded into a single strand without slits or cutting. The monofilament yarn may have any suitable cross-sectional shape including, but not limited to, round, rectangular, flat, diamond or triangular.

The term "monotape," as used herein is a cast film that is slit to form single tapes.

The term "olefin-based polymer," as used herein, is a polymer containing, in polymerized form, a majority weight percent of an olefin, for example ethylene or propylene, based on the total weight of the polymer. Nonlimiting examples of olefin-based polymers include ethylene-based polymers and propylene-based polymers.

The term "polymer," as used herein, is a macromolecular compound prepared by polymerizing monomers of the same or different type. "Polymer" includes homopolymers, copolymers, terpolymers, interpolymers, and so on. The term "interpolymer" is a polymer prepared by the polymerization of at least two types of monomers or comonomers. It includes, but is not limited to, copolymers (which usually refers to polymers prepared from two different types of monomers or comonomers, terpolymers (which usually refers to polymers prepared from three different types of monomers or comonomers), tetrapolymers (which usually refers to polymers prepared from four different types of monomers or comonomers), and the like.

The term "polyolefin" and like terms, as used herein, is a polymer derived from one or more simple olefin monomers, e.g., ethylene, propylene, 1-butene, 1-hexene, 1-octene and the like. The olefin monomers can be substituted or unsubstituted and if substituted, the substituents can vary widely. For purposes of this disclosure, substituted olefin monomers include vinyltrimethoxy silane, vinyl acetate, $C_{2-6}$ alkyl acrylates, conjugated and nonconjugated dienes, polyenes, vinylsiloxanes, carbon monoxide and acetylenic compounds. If the polyolefin is to contain unsaturation, then preferably at least one of the comonomers is at least one nonconjugated diene such as 1,7-octadiene, 1,9-decadiene, 1,11-dodecadiene, 1,13-tetradecadiene, 7-methyl-1,6-octadiene, 9-methyl-1,8-decadiene and the like, or a siloxane of the formula $CH_2{=}CH{-}[Si(CH_3)_2{-}O]_n{-}Si(CH_3)_2{-}CH{=}CH_2$ in which n is at least one. Many polyolefins are thermoplastic and for purposes of this disclosure, can include a rubber phase. Polyolefins include but are not limited to polyethylene, polypropylene, polybutene, polyisoprene and their various interpolymers.

The term "propylene-based polymer," as used herein, is a polymer that comprises a majority weight percent polymerized propylene monomer (based on the total amount of polymerizable monomers), and optionally may comprise at least one polymerized comonomer.

The term "residual elongation" is the strain at fiber break.

The term "shock absorption layer," as used herein, is a pad placed under an artificial turf that absorbs an impact force imposed upon the artificial turf.

The term "spinneret," as used herein, is a multi-pored device through which a plastic polymer melt is extruded to form polymer strands.

The term "shrinkage," as used herein, is the percentage length reduction of 1 meter of yarn after inserting the yarn in 90° C. hot silicon oil for 20 seconds. Shrinkage is calculated by subtracting the reduced yarn length (measured immediately after removal from the oil bath) from the original yarn length and dividing the result by the original yarn length and multiplying by 100.

The tem "tenacity," as used herein, is the breaking load of a yarn. Tenacity is measured as the tensile stress at break divided by the linear weight of the yarn (dtex of denier), cN/dtex.

The term "tufting," as used herein, is positioning needles across the width of a backing substrate, and pulling a yarn through the backing substrate. When the needle returns, a loop is formed. The loop is cut at the top so the yarn will project from the backing substrate.

TEST PROCEDURES

Density is measured in accordance with ASTM D 792.

Melt Index (MI) is measured in accordance with ASTM D 1238 190° C., 2.16 kg.

Draw Ratio. The draw ratio is measured by passing a yarn over a slow speed group of rollers, and then drawing the yarn through a heated oven. At the exit of the oven, the yarn is passed onto a second group of rollers that are run at a substantially higher speed than the slow speed group of rollers. The linear velocity ratio of the rollers after the oven to the rollers in front of the drawing oven is the draw ratio. The draw temperature is approximately between 85° C. and 120° C. In a second annealing oven with an annealing temperature from 85° C. to of 120° C. the yarn is relaxed by running the rollers after the second oven at slower speed than the rollers in between the drawing and relaxation ovens.

Crystallinity. Percent crystallinity can be determined by differential scanning calorimetry (DSC), using a TA Instruments Model Q1000 Differential Scanning calorimeter. A sample of about 5-8 mg size is cut from the material to be tested, and placed directly in the DSC pan for analysis. For higher molecular weight materials, a thin film is normally pressed from the sample, but for some lower molecular weight samples, they may be either too sticky or flow too readily during pressing. Samples for testing may, however, be cut from plaques that are prepared, and used, for density testing. The sample is first heated at a rate of about 10° C./min to 180° C. for ethylene-based polymers (230° C. for propylene-based polymers), and held isothermally for three minutes at that temperature to ensure complete melting (the first heat). Then the sample is cooled at a rate of 10° C. per minute to −60° C. for ethylene-based polymers (−40° C. for propylene-based polymers), and held there isothermally for three minutes, after which, it is again heated (the second heat) at a rate of 10° C. per minute until complete melting. The thermogram from this second heat is referred to as the "second heat curve." Thermograms are plotted as watts/gram versus temperature.

The percent crystallinity in the ethylene-based polymers may be calculated using heat of fusion data, generated in the second heat curve (the heat of fusion is normally computed automatically by typical commercial DSC equipment, by integration of the relevant area under the heat curve). The equation for ethylene-based polymers is percent Cryst.=($\Delta H_f$÷292 J/g)×100; and the equation for propylene-based polymers is:

percent Cryst.=($\Delta H_f$÷165 J/g)×100.

The "percent Cryst." represents the percent crystallinity and "$\Delta H_f$" represents the heat of fusion of the polymer in Joules per gram (J/g).

Tenacity and Elongation. Tenacity and elongation are measured on an MTS (Machine Testing Systems (MN)) or like machine by placing an individual tape between two grips and measuring the force it takes to stretch the material until failure. The distance between the grips is set at 4 in (100 mm) and the testing speed chosen at 10 in/min (250 mm/min). This test is performed five times for each sample to provide consistency in data. Using the break load and denier, the tenacity (Equation 1) is determined for each sample. Elongation is calculated using Equation 2. The test is carried out at 25° C.

Tenacity=Break load(cN)/dtex where dtex=Mass(g)/10,000 m and

Breakload(gf)=1.02 Break load(cN)

(Denier=1.1 dtex) Equation 1

$$\text{Elongation}=(L-L_o)/L_o \quad \text{Equation 2}$$

Where "L" is the length between the grips at any time during the tests and $L_o$ is the original distance between the grips. The value is typically reported in percent.

Elongation at failure is the elongation L at which the break load is reached and the tape breaks (fails).

Shrinkage. Shrinkage is the percentage length reduction of 1 meter of yarn after inserting the yarn in 90° C. hot silicone oil for 20 seconds. The yarn is measured immediately after removal from the bath using an appropriate length measuring device. The surface on which the yarn is placed should be free from defects so that the yarn may retract or shrink freely. Shrinkage is calculated by subtracting the reduced yarn length from the original yarn length and dividing the result by the original yarn length and multiplying by 100. Afterward each sample is measured and the percent shrinkage (Equation 3) is calculated.

Shrinkage=(Original Length−Measured Length)/Original Length Equation 3

By way of example and not limitation, examples of the present disclosure will now be given.

EXAMPLES

Blends are made on a single-screw extruder. Blend components and wt % of each is listed in Table 2. Wt % is based on total weight of the sample. The OBC (Infuse™ 9500) is an ethylene/octene multi-block interpolymer, with a hard segment content of about 22 wt %, a density of 0.877 g/cc, and a melt index of about 5 g/10 min (measured at 190° C. and 2.16 kg). The LLDPE (DOWLEX™ 2036G) has a density of 0.935 g/cc and a melt index of about 2.5 g/10 min (measured at 190° C. and 2.16 kg). The ethylene-octene (E/O) random copolymer is AFFINITY 8100 (density of 0.870 g/cc and a melt index of about 1 g/10 min). The ethylene-octene, metallocene catalyzed sLLDPE copolymer is ELITE 5230G (density of 0.916 g/cc and a melt index of about 4 g/10 min).

All blends are extruded into monofilaments on the same monofilament extrusion line with a two oven set up: one stretching/drawing oven and one relaxation/annealing oven to minimize shrinkage.

Table 1 provides process parameters for the production of the monofilament.

TABLE 2

Components and Properties of Tested Blends

| (Wt %) | Draw Ratio | Tenacity (cN/dtex) | Elongation at Failure (%) | Shrinkage (%) |
|---|---|---|---|---|
| Example 1 40% OBC 60% LLDPE | 4.88 | 0.97 | 123 | 2.1 |
| Example 2 30% OBC 70% LLDPE | 5.0 | 0.75 | 95.6 | 5.5 |
| Comparative Sample 1 15% E/O random copolymer 85% LLDPE | 4.8 | 1.03 | 58.8 | 11 |
| Comparative Sample 2 30% E/O random copolymer 70% LLDPE | 3.7 | 0.7 | 71.0 | 29 |
| Comparative Sample 3 100% ELITE 5230G | 5.5 | 1.08 | 75 | 10.1 |

Wt % = based on total weight of sample

The blends then are converted into monofilaments with a spinneret containing 168 holes in a circular configuration

TABLE 1

| | Example 1 | Example 2 | Comparative sample 3 Elite 5230G | Comparative sample 2 70% Dowlex SC2108G + 30% Affinity 8100G | Comparative sample 1 85% Dowlex SC2108G + 15% Affinity 8100G |
|---|---|---|---|---|---|
| T Ext 1 (° C.) | 180 | 180 | 180 | 190 | 190 |
| T Ext 2 (° C.) | 220 | 220 | 220 | 200 | 200 |
| T Ext 3 (° C.) | 230 | 230 | 230 | 220 | 220 |
| T Ext 4 (° C.) | 230 | 230 | 230 | 220 | 220 |
| T Ext 5 (° C.) | 230 | 230 | 230 | 220 | 220 |
| T Adapter | 230 | 230 | 230 | 220 | 220 |
| T Filter 1 (° C.) | 230 | 230 | 230 | 230 | 230 |
| T Filter 2 (° C.) | 230 | 230 | 230 | 230 | 230 |
| T Melt pump (° C.) | 230 | 230 | 230 | 230 | 230 |
| T die 1 (° C.) | 230 | 230 | 230 | 220 | 220 |
| T die 2 (° C.) | 230 | 230 | 230 | 220 | 220 |
| T die 3 (° C.) | 230 | 230 | 230 | 220 | 220 |
| Temperature melt (° C.) | 232 | 232 | 230 | 229 | 228 |
| RPM Extruder | 49 | 50.3 | 50.7 | 44.8 | 47.9 |
| RPM melt pump | 20.3 | 20.3 | 20.3 | 18.4 | 18.4 |
| Pressure before filter (bar) | 80 | 78 | 82 | 109 | 108 |
| Pressure after filter (bar) | 50 | 49 | 50 | | |
| Pressure after melt pump (bar) | 114 | 107 | 89 | 141 | 137 |
| Cooling Bath Temp. (° C.) | 28 | 29 | 31 | 32 | 32 |
| Dis. die-water bath [mm] | 30 | 30 | 30 | 30 | 30 |
| Stretching unit 1 [m/min] | 33.3 | 32.5 | 30.5 | 30 | 30 |
| Stretching unit 2 [m/min] | 162.6 | 162.5 | 167.8 | 110 | 145.2 |
| Fixing unit 1 [m/min] | 123 | 123 | 123 | 104 | 120 |
| Stretching unit 3 [m/min] | 125 | 125 | 124.9 | 104 | 120 |
| Stretching ratio | 4.881 | 5.002 | 5.502 | 3.666 | 4.836 |
| Relaxation ratio | 0.757 | 0.757 | 0.733 | 0.945 | 0.845 |
| T Hot air oven 1 (° C.) | 96 | 96 | 96 | 92 | 92 |
| T hot air oven 2 (° C.) | 103 | 103 | 97 | 109 | 108 |
| T stretching unit 1 | 70 | 70 | 67 | 90 | 90 |
| T stretching unit 2 | 97 | 97 | 97 | 80 | 80 |
| T fixing unit 1 | 95 | 95 | 95 | 75 | 75 |
| dtex | 1330 | 1305 | 1330 | 1492 | 1237 |
| Tenacity [cN/dtex] | 0.97 | 0.75 | 1.08 | 0.7 | 1.03 |
| Residual Elongation [%] | 123.0 | 95.6 | 75.5 | 71 | 58.8 |
| Shrinkage [%] | 2.1 | 5.5 | 10.1 | 29 | 11 |
| Green Masterbatch (%) | 4 | 4 | 4 | 4 | 4 |
| Processing Aid (%) | 0.5 | 0.5 | 0.5 | 0.5 | 0.5 |

subsequently quenched into a water bath, drawn through a hot air oven and then annealed in an oven via hot air and rolls. The draw temperature is approximately 96° C. with an annealing temperature of 103° C. Masterbatches containing green pigment, (Grafe 56103-GR Olivegreen RAL 6003 available from Grafe, Germany) UV stabilizer and processing aid (Polybatch™ AMF 705HF available from AG Schulmann) are added in-line at a level of 4.5 wt %.

As shown in Table 1 and 2, blends with the OBC display exceptional heat resistance, as measured by the percentage of shrinkage. In addition, the blends with OBC display the desired properties of strength (tenacity) and softness (density).

The blends and yarns of the present disclosure are advantaged over styrene block copolymers, which are used in other artificial turf systems, because the OBCs have better inherent thermal and UV stability compared to the styrene-based materials. As a result, yarns of the present disclosure are less likely to shrink and curl during coating and in-play compared to other ethylene-α-olefins at similar density. Additionally, the abrasion resistance of olefin-block copolymers is advantaged over other thermoplastic elastomers, which leads to better durability in a tufted carpet.

The present blends and yarns are unique in that the blocks which provide the heat resistance are based on high-density polyethylene rather than either styrene blocks or linear chains of polypropylene. The abrasion resistance of the olefin block copolymers has also shown to be unique compared to other block copolymers based on styrene, ethylene, and/or butadiene, and isoprene.

The present blends and yarns are unique in that the shrinkage value is about half the value that has been achieved with conventional technology.

It is specifically intended that the present disclosure not be limited to the embodiments and illustrations contained herein, but include modified forms of those embodiments including portions of the embodiments and combinations of elements of different embodiments as come within the scope of the following claims.

What is claimed is:

1. An artificial turf yarn comprising:

from about 10 wt % to about 80 wt % of an olefin block copolymer (OBC) having a density from about 0.866 g/cc to less than 0.900 g/cc and from about 20 wt % to about 90 wt % of a linear low density polyethylene (LLDPE) having a density from 0.910 g/cc to 0.935 g/cc, the yarn having a shrinkage less than 8%.

2. The artificial turf yarn of claim 1 having a tenacity greater than about 0.7 cN/dtex.

3. The artificial turf yarn of claim 1 having an elongation at failure greater than about 80%.

4. The artificial turf yarn of claim 1, wherein the OBC has a melt index from about 0.5 g/10 min to about 5 g/10 min as measured in accordance with ASTM D1238 190° C./2.16 kg.

5. The artificial turf yarn of claim 1, wherein the LLDPE has a melt index from about 0.5 g/10 min to about 10 g/10 min as measured in accordance with ASTM D1238 190° C./2.16 kg.

6. The artificial turf yarn of claim 1, wherein the yarn comprises from about 20 wt % to about 50 wt % of the OBC and from about 50 wt % to about 80 wt % of the LLDPE.

7. The artificial turf yarn of claim 1, wherein the yarn has a density from about 0.905 g/cc to about 0.940 g/cc and a shrinkage less than 6%.

8. The artificial turf yarn of claim 1, wherein the yarn has a melt index from about 1 g/10 min to about 5 g/10 min as measured in accordance with ASTM D1238 190° C./2.16 kg.

9. An artificial turf yarn comprising:

from about 10 wt % to about 80 wt % of an olefin block copolymer (OBC) having a density from about 0.866 g/cc to less than 0.900 g/cc and from about 20 wt % to about 90 wt % of a linear low density polyethylene (LLDPE) having a density from 0.910 g/cc to 0.935 g/cc, the yarn having a density less than 0.920 g/cc and a shrinkage less than 6%.

10. The artificial turf yarn of claim 9, wherein the OBC has a density from about 0.866 g/cc to about 0.887 g/cc.

11. The artificial turf yarn of claim 9, wherein the LLDPE has a density of 0.935 g/cc.

12. The artificial turf yarn of claim 9, wherein the OBC has a melt index from about 0.5 g/10 min to about 5 g/10 as measured in accordance with ASTM D1238 190° C./2.16 kg.

13. The artificial turf yarn of claim 9, wherein the LLDPE has a melt index from about 0.5 g/10 min to about 10 g/10 min as measured in accordance with ASTM D1238 190° C./2.16 kg.

14. An artificial turf comprising:

a backing substrate; and a yarn coupled to the backing substrate, the yarn comprising from about 10 wt % to about 80 wt % of an olefin block copolymer (OBC) having a density from about 0.866 g/cc to less than 0.900 g/cc and from about 20 wt % to about 90 wt % of a linear low density polyethylene (LLDPE) having a density from 0.910 g/cc to 0.935 g/cc.

15. The artificial turf of claim 14, wherein the OBC has a density from about 0.866 g/cc to about 0.887 g/cc.

16. The artificial turf yarn of claim 1, wherein the OBC is an ethylene multi-block interpolymer having an ethylene content from 55 wt % to 95 wt %.

17. The artificial turf yarn of claim 9, wherein the OBC is an ethylene multi-block interpolymer having an ethylene content from 55 wt % to 95 wt %.

18. The artificial turf yarn of claim 14, wherein the OBC is an ethylene multi-block interpolymer having an ethylene content from 55 wt % to 95 wt %.

* * * * *